US007520090B2

(12) United States Patent
Gerhart

(10) Patent No.: US 7,520,090 B2
(45) Date of Patent: Apr. 21, 2009

(54) WALL OR DOOR ELEMENT PROVIDED WITH SECURING MEMBERS FOR PREVENTING CASTORS FROM LIFTING OFF FROM A RUNNER

(75) Inventor: Günter Gerhart, Homburg (DE)

(73) Assignee: Raumplus Guddas GmbH & Co., KG, Bremen (DE)

( * ) Notice: Subject to any disclaimer, the term of this patent is extended or adjusted under 35 U.S.C. 154(b) by 176 days.

(21) Appl. No.: 10/524,526

(22) PCT Filed: Aug. 20, 2003

(86) PCT No.: PCT/EP03/09205

§ 371 (c)(1),
(2), (4) Date: Feb. 10, 2005

(87) PCT Pub. No.: WO2004/025060

PCT Pub. Date: Mar. 25, 2004

(65) Prior Publication Data

US 2005/0284028 A1 Dec. 29, 2005

(30) Foreign Application Priority Data

Sep. 10, 2002 (DE) ..... 102 42 208

(51) Int. Cl.
*E05D 15/06* (2006.01)

(52) U.S. Cl. ..... 49/425; 49/411

(58) Field of Classification Search ..... 49/410, 49/411, 425; 16/90, 91
See application file for complete search history.

(56) References Cited

U.S. PATENT DOCUMENTS

| | | | | | |
|---|---|---|---|---|---|
| 3,033,285 | A | * | 5/1962 | Banner | 49/425 |
| 4,064,592 | A | | 12/1977 | Piegelman | |
| 4,404,771 | A | * | 9/1983 | Murase et al. | 49/425 |
| 4,633,615 | A | | 1/1987 | Moose | |
| 4,639,970 | A | * | 2/1987 | Adams | 16/90 |
| 4,811,683 | A | * | 3/1989 | Gephart et al. | 16/97 |
| 5,671,502 | A | * | 9/1997 | Ezman | 16/105 |
| 5,927,017 | A | * | 7/1999 | Jacobs et al. | 49/410 |

FOREIGN PATENT DOCUMENTS

| | | |
|---|---|---|
| EP | 0278162 A1 | 8/1988 |
| EP | 0 856 627 B1 | 8/1998 |

* cited by examiner

*Primary Examiner*—Gregory J. Strimbu
(74) *Attorney, Agent, or Firm*—Laurence P. Colton; Smith, Gambrell & Russell

(57) ABSTRACT

A door or wall element comprising castor carriers (21)having castors (12)which are movable on a runner (13) and securing members (28) having securing hooks (31, 32) which are disposed in the runner (13) and prevent the castors (12) from undesirably lifting off from the runner (13). The securing members (28) are mounted rotatably on castor axles (23) of the castors.

10 Claims, 4 Drawing Sheets

Fig. 1
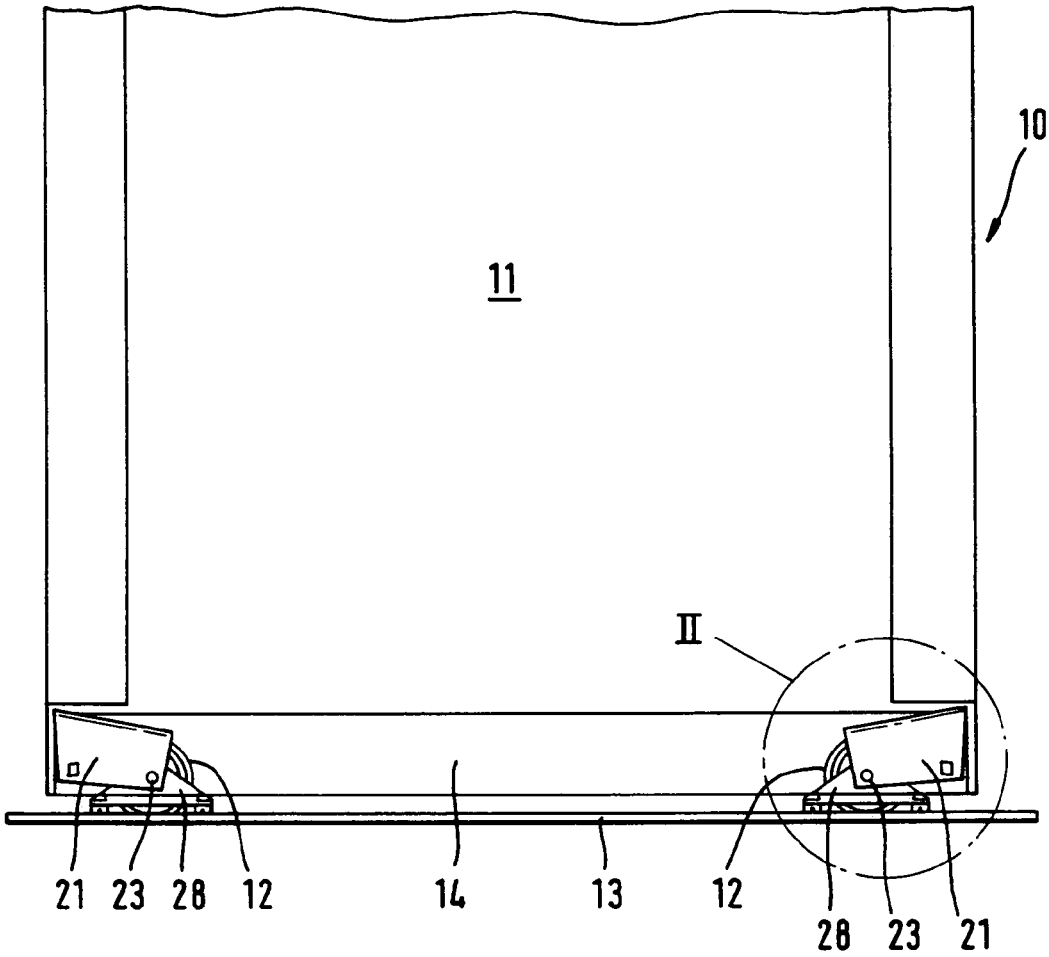
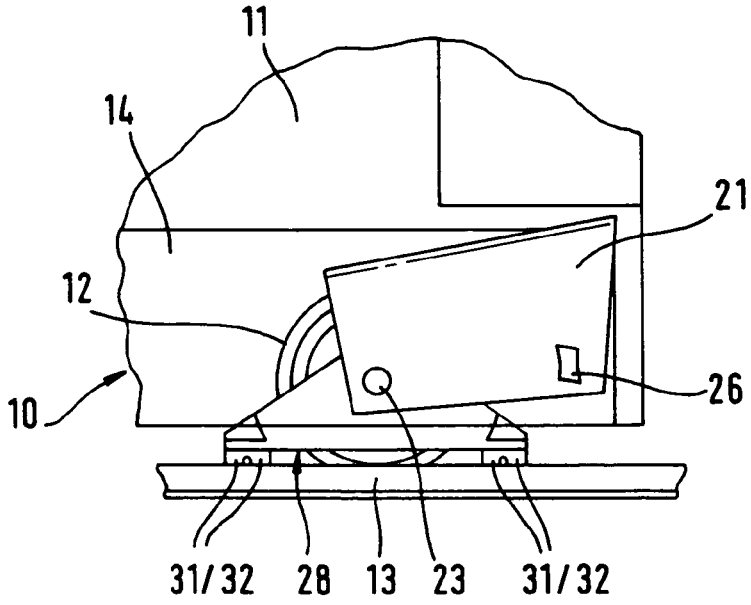
Fig. 2

WALL OR DOOR ELEMENT PROVIDED WITH SECURING MEMBERS FOR PREVENTING CASTORS FROM LIFTING OFF FROM A RUNNER

STATEMENT OF RELATED APPLICATIONS

This patent application is the Patent Cooperation Treaty (PCT) Chapter II National Phase application in the United States of International Application No.

PCT/EP2003/009205 having an International Filing Date of 20 Aug. 2003 and a Priority Date of 10 Sep. 2002 based and claiming priority on German Patent Application No. 10242208.7, and designating the United States.

BACKGROUND OF THE INVENTION

1. Technical Field

The invention relates to a wall element or door element—element—having (lower) castors which can be moved on floor runners which are designed as hollow bodies with a slot running in the longitudinal direction, with the runners being mounted in each case on an adjustable castor carrier and the latter being connected to the element.

2. Prior Art

Wall elements or door elements of this type are also referred to as sliding walls or sliding doors. They conventionally consist of a supporting frame which runs all the way round and has hollow profiles, predominantly made of aluminium. Castors are fitted to the elements at the bottom and top. The lower castors enter into a slot of a floor runner and can thus be moved along the runner with lateral guidance being ensured. A filling comprising panel elements is conventionally connected to the frame.

In order to adapt the wall element or door element to local structural stipulations, vertical adjustability is provided. Since the castors always have to have contact with the floor runners, the element can be raised and lowered relative to the castors. For this purpose, the castor carrier, which is preferably designed as a pivotable lever, is adjustable. With the elements closed on both sides, the castor carrier is actuated from a narrow side of the element, namely is pivoted in order to vertically adjust the element in one or other direction.

BRIEF SUMMARY OF THE INVENTION

The invention is based on the object of improving wall elements or door elements of the described type with regard to the functionality, in particular of ensuring that the castors are supported on the floor runners.

In order to achieve this object, the wall element or door element according to the invention and the (floor) castor carrier are characterized by the following features:

a) a securing member is fitted in the region of at least one castor, the said securing member entering with anchoring ends into the runner and securing the element against lifting off, b) the securing member is mounted on an axis of rotation of the castor.

The wall element or door element according to the invention is secured against lifting off by the securing member as a result of being anchored in the hollow runner. The securing member is preferably designed as a tilting lever which is mounted pivotably on the axis of rotation of the castor and enters with anchoring ends into the runner in a form-fitting manner. In this case, the anchoring ends are designed as hook-shaped elements having thickened areas or hooking elements at the ends in the runner.

The mounting of the securing member (exclusively) on the axis of rotation of the castor means that the securing member is independent of any lifting movements of the element relative to the castor. As a result, the castor carrier, as connecting member between the castor and element, can be designed as a member which can be tilted in a vertical plane and which is actuated via a narrow side of the closed element by a suitable tool.

The securing member is constructed in a simple manner and consists, in particular, of plastic. The mounting of the securing member on the axis of rotation of the castor means that the castor unit can be produced in a simple manner and can be fitted in the conventional manner.

BRIEF DESCRIPTION OF THE DRAWINGS

Further characteristic features of the invention will be explained in greater detail below with reference to the drawings, in which:

FIG. 1 shows a lower sub-region of a wall element or door element in side view, FIG. 2 shows a detail II from FIG. 1 on an enlarged scale.

DETAILED DESCRIPTION OF THE PREFERRED EMBODIMENTS

Figure 3:
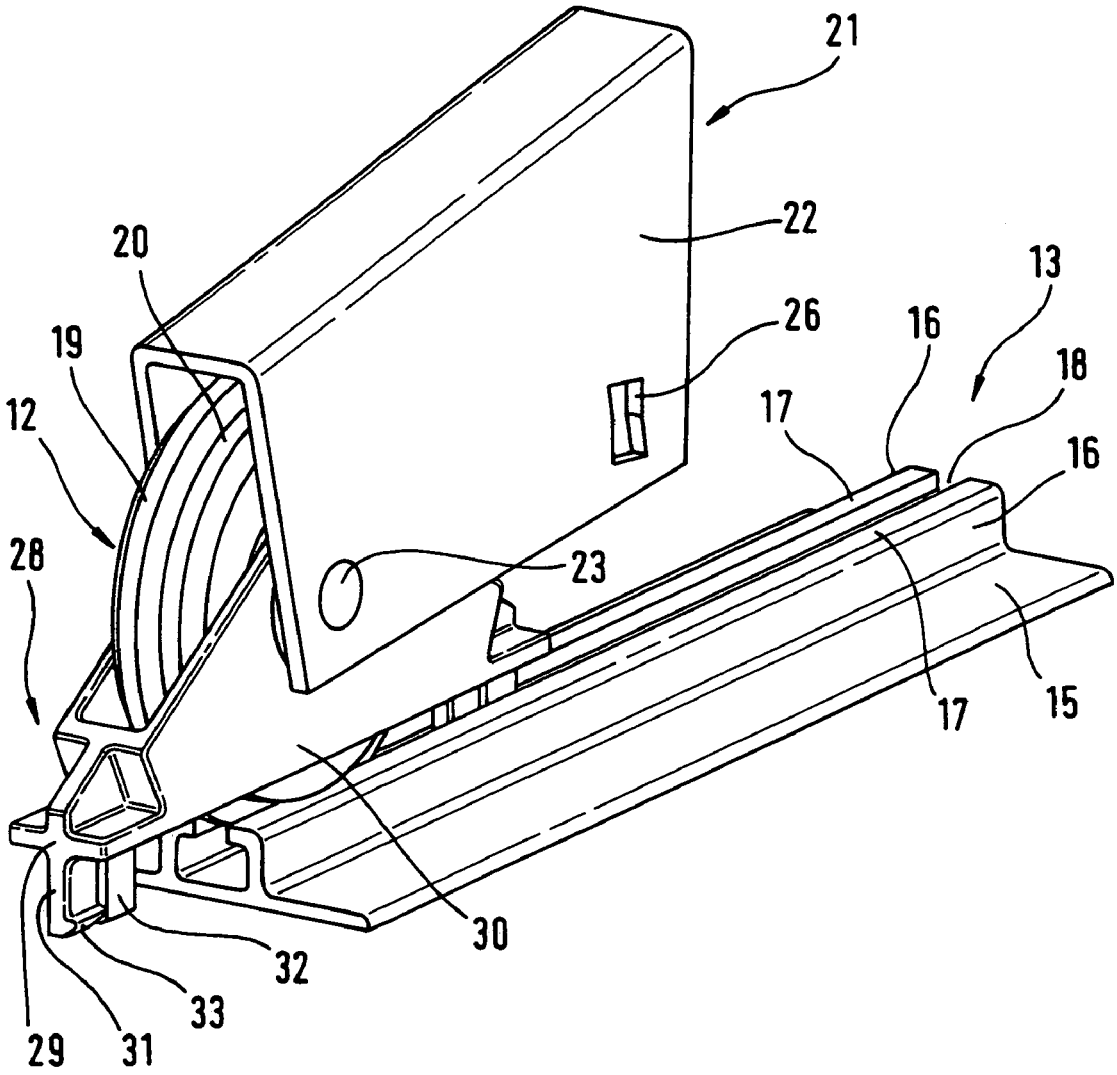
FIG. 3 shows a castor unit together with the runner in a perspective illustration on an even more enlarged scale.
Figure 4:
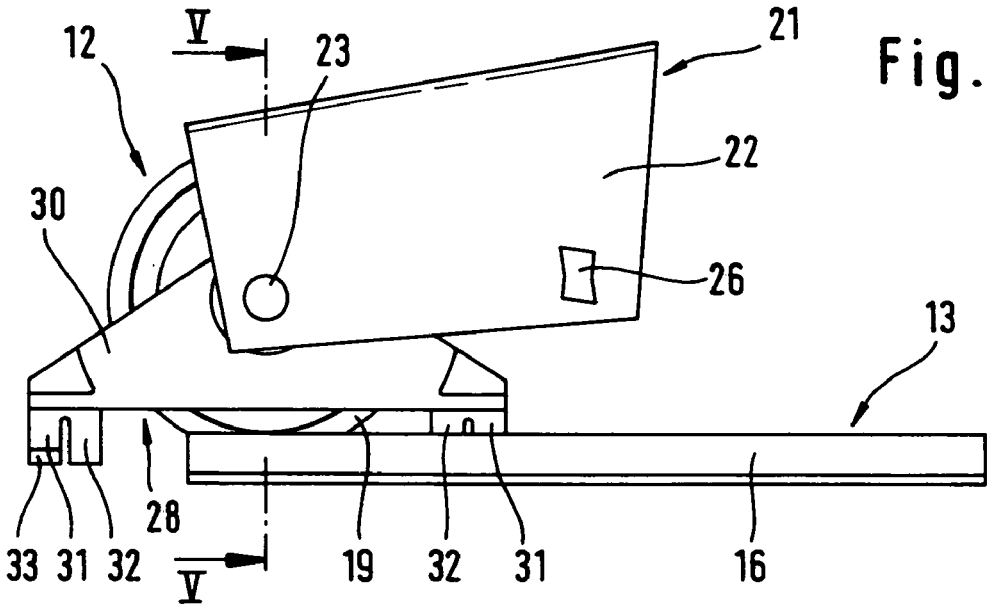
FIG. 4 shows the castor unit according to FIG. 3 in side view.
Figure 5:
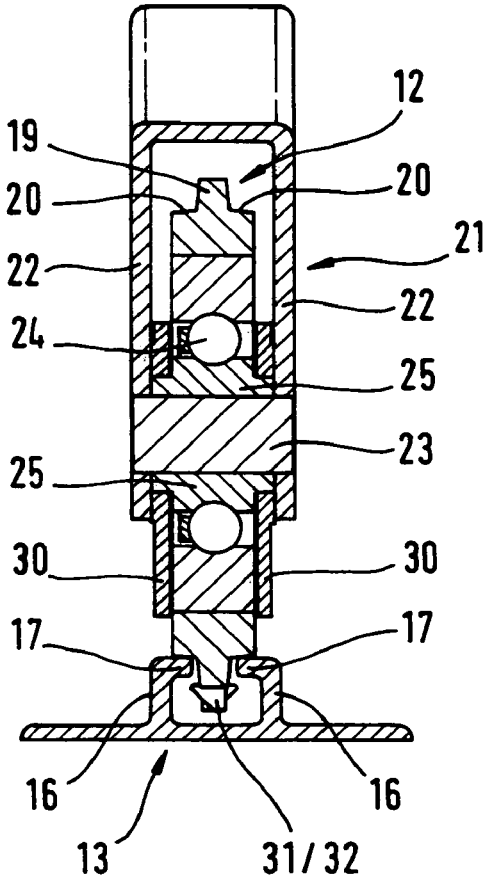
FIG. 5 shows a vertical section through the castor unit according to FIG. 4 in the sectional plane V-V.
Figure 6:
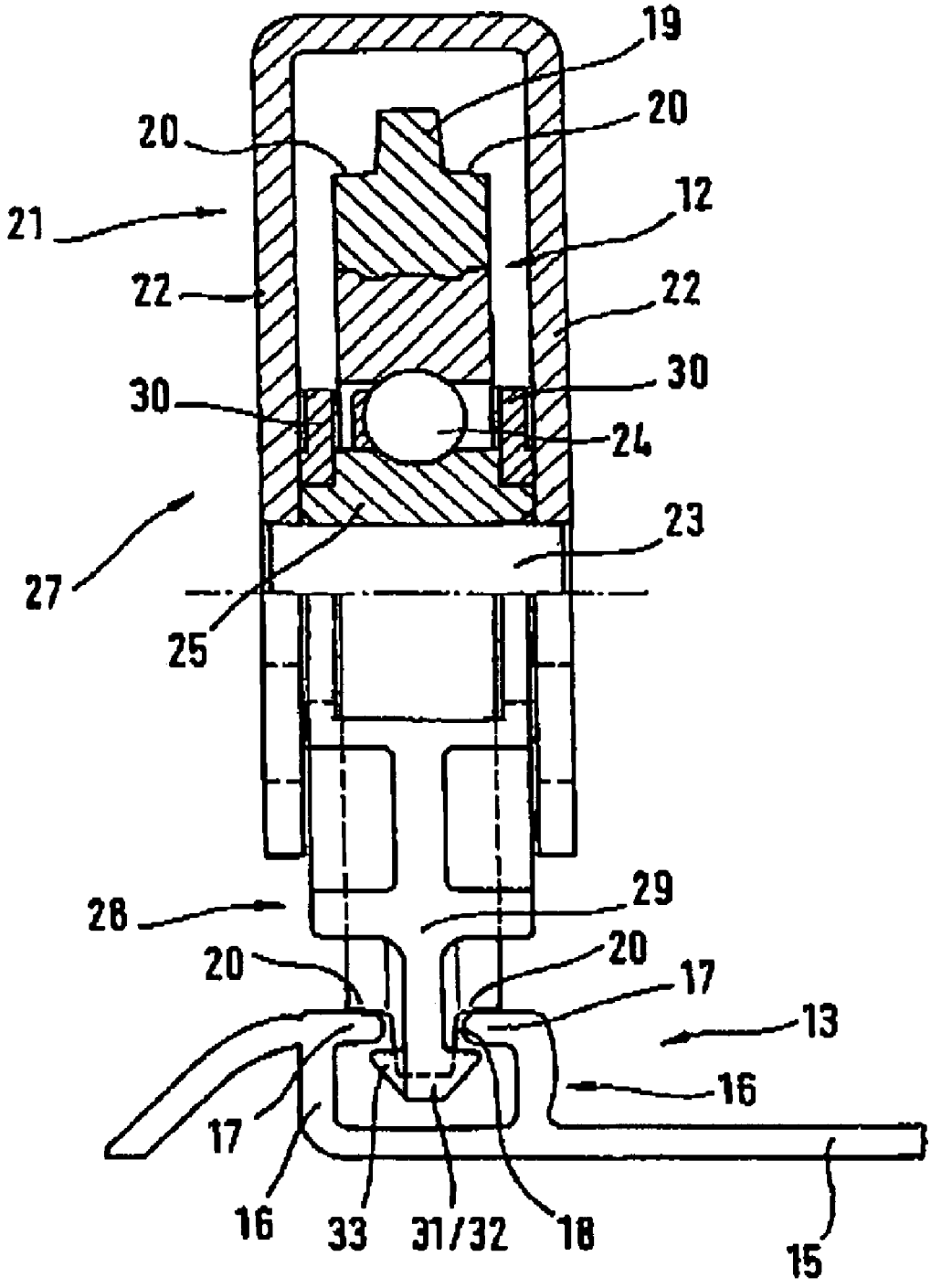
FIG. 6 shows the castor unit with a vertical subsection and front view in the lower region.

FIG. 1 shows a lower sub-region of a wall element or door element which has a frame 10 running all the way around. Covering panels 11 are fitted on both sides of the frame 10, with the result that the wall element or door element is closed on both sides.

The wall element or door element can be moved by means of lower castors 12 on a runner 13, which is fitted on the floor. Two castors 12 are fitted to ends of a lower transverse strut 14 of the frame 10.

The runners 13, which are fixed on or in the floor, are designed as a hollow profile, namely with a lower flange 15 and two angled supporting profiles 16 which form the actual runner. The supporting profiles 16 have mutually facing runner limbs 17. A central guide slot 18 is formed between the said runner limbs.

The castors 12 are profiled in coordination with the design and size of the runner 13. A central guide rim 19 running all the way around enters in a fitting manner into the guide slot 18 of the runner 13 and thus effects lateral guidance of the castors 12 and therefore of the wall element or door element. Circular supporting surfaces formed on both sides of the guide rim 19 rest on the runner limbs 17 on both sides of the guide slot 18 and roll along said limbs. The castors are designed in a particular manner with regard to the design of these supporting surfaces 20 or shoulders, namely with an inclination which slopes outwards in each case of the order of magnitude of (approximately) 5°. This slightly inclined design of the supporting surfaces 20 brings about an improvement in the running characteristics of the castors 20, in particular in such a manner that unevenness in the runners 13 is compensated for.

Each castor 12 is connected to the element or to the frame 10 via an adjustable securing means. This involves a castor carrier 21 which is designed, in the example shown, as a U-shaped supporting element, in particular made from correspondingly deformed sheet metal. The castor 12 is positioned between upright supporting limbs 22. A transversely directed castor axle 23 connects the two supporting limbs 22 to each other. The castor 12 is mounted rotatably on the castor axle 23 by means of a ball bearing 24. In the present exemplary embodiment, a hub 25 extending between the supporting limbs 22 is fitted on the castor axle 23. The ball bearing 24 runs on said hub.

The castor 12 is connected eccentrically, namely in the region of a lower, edge-side corner, to the castor carrier 21. In the region of an opposite corner, the castor carrier 21 is connected to the element or to the transverse strut 14, specifically via an opening 26. The castor carrier 21 can be adjusted about the castor axle 23, by a pivoting movement in the present case. The castor 12 always remains in the position bearing against the runner 13. The pivoting movement of the castor carrier 21 causes the door element or wall element to be raised or lowered relative to the castor 12. In order to adjust the castor carrier 21, use is made of an adjusting gear (not illustrated) which can be actuated via a narrow side of the door element or wall element, i.e. via an upright strut of the frame 10.

The door element or wall element is equipped with a permanent means of securing the castor 12 against undesirably lifting off from the runner 13. Each castor unit 27, which is formed from the castor 12 and castor carrier 21, has an anchoring member or securing member 28. The said member is provided with anchoring members or hooking members which enter into the runner 13 in a form-fitting manner, but with a little play, and, by being supported on the runner limbs 17, prevent the castor 12 from being lifted off. In the present exemplary embodiment, the securing member 28 comprises a shaped element, in particular made of plastic, comprising a lower web 29 and upright supporting wall 30.

In the exemplary embodiment shown, the securing member 28 has (in side view) a triangular design. In an upper region, the supporting walls 30 are connected centrally to the castor unit 27, specifically to the castor axle 23. The securing member 28 is accordingly connected to the castor carrier 21 exclusively via the castor axle 23. For this purpose, the securing member 28 has two supporting walls 30 which are arranged at a distance from each other, are positioned between the supporting limbs 22 of the castor carrier 21 and are mounted on the hub 25 by means of a corresponding opening. For this purpose, the hub 25 is formed at its ends with a step, in the region of which the supporting walls 30 are mounted on the hub 25.

The castor 12 can accordingly be rotated freely irrespective of the position of the securing member 28. The securing member 28 acts in the manner of a rocker. The anchoring members, which enter with a thickened area into the runner 13, are fitted at the ends, namely at the ends of the web 29. In the present exemplary embodiment, two securing hooks 31, 32 are provided in each case and are anchored in a form-fitting manner in the runner 13 by means of hook-like projections 33. The projections 33 of the two securing hooks 31, 32 are directed to different sides.

This design of the castor unit 27 with securing member 28 ensures that the door element or wall element can be moved up and down without any effect on the position of the securing member 28.

List of Reference Numbers

10 Frame
11 Covering panel
12 Castor
13 Runner
14 Transverse strut
15 Flange
16 Supporting profile
17 Runner limb
18 Guide slot
19 Guide rim
20 Supporting surface
21 Castor carrier
22 Supporting limb
23 Castor axle
24 Ball bearing
25 Hub
26 Opening
27 Castor unit
28 Securing member
29 Web
30 Supporting wall
31 Securing hook
32 Securing hook
33 Projection

What is claimed is:

1. A wall or door element comprising:

a) a lower castor (12);

b) a castor carrier (21) for carrying the castor (12), wherein the castor carrier (21) is a U-shaped element having two upright supporting limbs (22) between which the castor (12) is mounted;

c) a transversely directed with respect to and castor axle (23) connecting the two supporting limbs (22) to each other;

d) a hub (25) located on the castor axle (23), wherein the castor (12) is rotatably mounted on the hub (25) by ball bearings (24);

e) a floor runner (13) comprising two runner limbs (17) which the castor (12) rollably engages and a guide slot (18) between the runner limbs (17);

f) a securing member (28) pivotally mounted on the hub (25), wherein the securing member (28) prevents the castor (12) from lifting off of the floor runner (13), the securing member (28) comprising:

i) two supporting walls (30) that are disposed a distance from each other and are pivotably mounted on the hub (25) on both sides of the castor (12); and ii) anchoring members each having securing hooks (31, 32), each said securing hook including a laterally directed projection (33), wherein the anchoring members extend into the floor runner (13) via the guide slot (18) with one of said anchoring members in front of said castor in a direction in which the castor rolls and another one of said anchoring members behind said castor in said direction, whereby the laterally directed projections (33) of the securing hooks (31, 32) are located underneath the runner limbs (17), wherein the wall or door element is movable via the lower castor (12) on the floor runner (13) and the wall or door element is at least partially liftable and lowerable relative to the castor (12).

2. The wall or door element according to claim 1, wherein:

a) the castor (12) comprises a central guide rim (19) having two sides,the guide rim (19) entering into the guide slot (18) of the floor runner (13); and b) the castor (12) further comprises supporting surfaces (20) each disposed at a respective one of said sides of the guide rim (19) and resting on the runner limbs (17) of the floor runner (13).

3. The wall or door element according to claim 2, wherein the castor carrier (21) is connected pivotably to a frame (10) of the wall or door element.

4. The wall or door element according to claim 2, wherein the supporting surfaces (20) of the castor (12) (13) are each outwardly directed with respect to said guide rim and have a sloping inclination of approximately 5 degrees relative to said floor runner.

5. The wall or door element according to claim 1, wherein the securing member (28) has a triangular shape, with an upper, central corner region thereof being mounted on the hub (25).

6. A wall or door element comprising:

a) a castor element comprising a lower castor (12); a U-shaped castor carrier (21) having two upright supporting limbs (22); a castor axle (23) transversely directed with respect to and connecting the two supporting limbs (22) to each other; and a hub (25) located on the castor axle (23), wherein the castor (12) is rotatably mounted on the hub (25) between the two upright supporting limbs (22);

b) a floor runner (13) comprising two runner limbs (17) which the castor (12) rollably engages; and a guide slot (18) between the runner limbs (17); and c) a securing member (28) pivotally mounted on the hub (25), the securing member comprising two supporting walls (30) disposed a distance from each other and pivotably mounted on the hub (25) on both sides of the castor (12); and anchoring members each having securing hooks (31, 32), each said securing hook including a laterally directed projection (33), wherein the anchoring members extend into the floor runner (13) via the guide slot (18) with one of said anchoring members in front of said castor in a direction in which the castor rolls and another one of said anchoring members behind said castor in said direction, whereby the securing hooks (31, 32) are retained within the floor runner (13), wherein the securing member (28) prevents the castor (12) from lifting off of the floor runner (13), wherein the wall or door element is movable via the lower castor (12) on the floor runner (13) and the wall or door element is at least partially liftable and lowerable relative to the castor (12).

7. The wall or door element according to claim 6, wherein the castor (12) further comprises:

a) a central guide rim (19) having two sides, the guide rim (19) entering into the guide slot (18); and b) supporting surfaces (20) each disposed at a respective one of said sides of the guide rim (19) and resting on a respective one of the runner limbs (17).

8. The wall or door element according to claim 7, wherein the castor carrier (21) is pivotably connected to a frame (10) of the wall or door element.

9. The wall or door element according to claim 7, wherein the supporting surfaces (20) are each outwardly directed with respect to said guide rim and have a sloping inclination of approximately 5 degrees relative to said floor runner.

10. The wall or door element according to claim 6, wherein the securing member (28) has a triangular shape, with an upper, central corner region thereof being mounted on the hub (25).

* * * * *

UNITED STATES PATENT AND TRADEMARK OFFICE

CERTIFICATE OF CORRECTION

PATENT NO. : 7,520,090 B2
APPLICATION NO. : 10/524526
DATED : April 21, 2009
INVENTOR(S) : Albert Frings et al.

It is certified that error appears in the above-identified patent and that said Letters Patent is hereby corrected as shown below:

On the title page, item [75]; should read:
Assignee: Raumplus GmbH & Co. KG., Bremen (DE)

Signed and Sealed this

Fifteenth Day of September, 2009

David J. Kappos

David J. Kappos
*Director of the United States Patent and Trademark Office*